US008851022B2

(12) United States Patent
Jacques et al.

(10) Patent No.: US 8,851,022 B2
(45) Date of Patent: Oct. 7, 2014

(54) WATER HEATING SYSTEM AND METHOD FOR USING THE SAME

(75) Inventors: Christopher J. Jacques, Barrington, NH (US); Andrew Hodsdon, Berwick, ME (US)

(73) Assignee: Laars Heating Systems Company, Rochester, NH (US)

( * ) Notice: Subject to any disclaimer, the term of this patent is extended or adjusted under 35 U.S.C. 154(b) by 1034 days.

(21) Appl. No.: 12/898,181

(22) Filed: Oct. 5, 2010

(65) Prior Publication Data

US 2012/0079995 A1 Apr. 5, 2012

(51) Int. Cl.

| | |
|---|---|
| ***F24H 9/02*** | (2006.01) |
| ***F24H 9/14*** | (2006.01) |
| ***F24H 9/20*** | (2006.01) |

(52) U.S. Cl.

CPC ..... *F24H 9/02* (2013.01); *F24H 9/148* (2013.01); *F24H 9/142* (2013.01); *F24H 9/2007* (2013.01)

USPC ..... 122/19.2; 122/40; 122/41; 29/700; D23/320

(58) Field of Classification Search

USPC ..... 122/19.2, 40, 41; D23/320, 329

See application file for complete search history.

(56) References Cited

U.S. PATENT DOCUMENTS

| | | | | |
|---|---|---|---|---|
| 4,019,570 | A * | 4/1977 | Siegel | 165/67 |
| 5,020,127 | A * | 5/1991 | Eddas et al. | 392/488 |
| D501,544 | S | 2/2005 | Smith et al. | |
| D502,253 | S | 2/2005 | Smith et al. | |
| D502,254 | S | 2/2005 | Smith et al. | |
| D509,184 | S | 9/2005 | Schuttler et al. | |
| D615,036 | S | 5/2010 | Liu et al. | |
| D619,689 | S | 7/2010 | Bartlett et al. | |
| D623,280 | S | 9/2010 | Bartlett et al. | |
| 8,297,525 | B1 * | 10/2012 | Bolivar | 236/20 R |
| 2003/0123863 | A1 * | 7/2003 | Hughes et al. | 392/449 |
| 2006/0088302 | A1 * | 4/2006 | Sturm | 392/480 |
| 2006/0144346 | A1 * | 7/2006 | Gordon et al. | 122/19.2 |
| 2008/0285964 | A1 * | 11/2008 | Sullivan | 392/485 |
| 2010/0086289 | A1 * | 4/2010 | Johnson et al. | 392/490 |
| 2012/0192813 | A1 * | 8/2012 | Evans et al. | 122/20 B |

* cited by examiner

*Primary Examiner* — Kang Hu

*Assistant Examiner* — Nathaniel Herzfeld

(74) *Attorney, Agent, or Firm* — RatnerPrestia

(57) ABSTRACT

A water heating system includes a housing that defines a substantially enclosed interior region. A control panel is attached to the housing and includes a display that displays a particular condition of the water heating system. An access panel is attached to the housing for movement between a first position and a second position, wherein, in the first position of the access panel, a passageway to the interior region of the housing is provided, and, in the second position of the access panel, the passageway to the interior region of the housing is closed. The display is visible in both positions of the access panel such that movement of the access panel from the second position to the first position facilitates simultaneous access to the display and to the interior region of the housing though the passageway.

3 Claims, 7 Drawing Sheets

WATER HEATING SYSTEM AND METHOD FOR USING THE SAME

FIELD OF THE INVENTION

The present invention relates to a water heating system and a maintenance access system for a water heating system.

BACKGROUND OF THE INVENTION

Hydronic boilers operate by way of heating water (or any other fluid) to a preset temperature and circulating the water throughout a building or a home typically by way of radiators, baseboard heaters, and so forth. Hydronic boilers typically include a burner, a gas valve, and a heat exchanger. The boiler may also include a gauge for displaying a condition of the boiler, such as temperature or pressure.

SUMMARY OF THE INVENTION

In one exemplary aspect, a water heating system is provided. A water heating system includes a housing that defines a substantially enclosed interior region. A control panel is attached to the housing and includes a display that displays a particular condition of the water heating system. An access panel is attached to the housing for movement between a first position and a second position, wherein, in the first position of the access panel, a passageway to the interior region of the housing is provided, and, in the second position of the access panel, the passageway to the interior region of the housing is substantially closed. The display is visible in both positions of the access panel such that movement of the access panel from the second position to the first position facilitates simultaneous access to the display of the control panel and to the interior region of the housing though the passageway.

In another exemplary aspect, a method for accessing a component within an interior region of a water heating system is provided. The method includes the steps of maintaining a control panel in a position adjacent a housing of the water heating system; moving an access panel of the water heating system from a closed position to an open position, thereby opening a passageway between the component and an exterior region of the water heating system; and accessing the component through the passageway while viewing the control panel.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features may be arbitrarily expanded or reduced for clarity. Included in the drawings are the following figures.

DETAILED DESCRIPTION OF THE INVENTION

Figure 1:
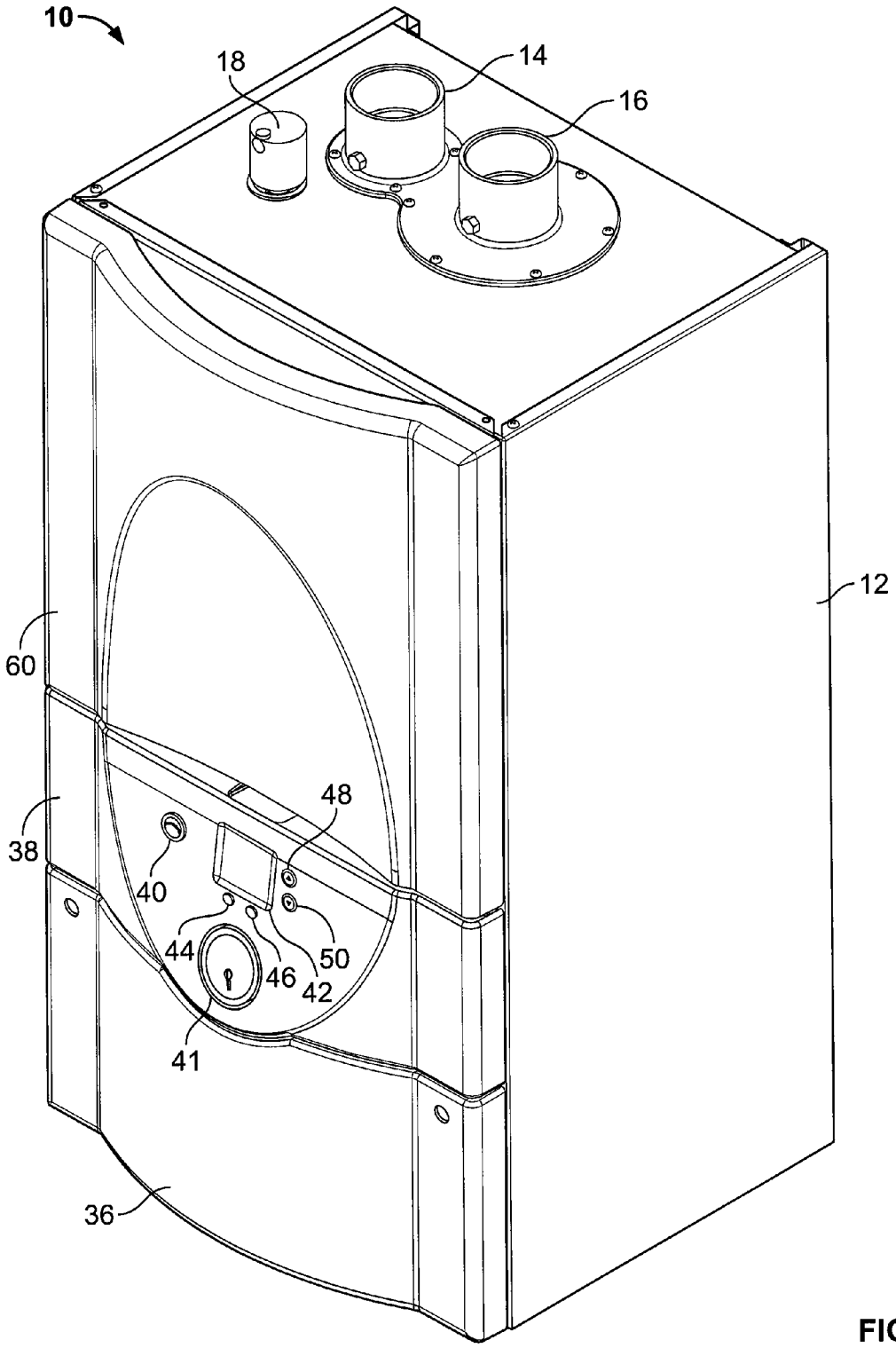
FIG. 1 is a perspective view of a water heating system according to one exemplary embodiment of the invention.

Although the invention is illustrated and described herein with reference to specific embodiments, the invention is not intended to be limited to the details shown. Rather, various modifications may be made to the illustrated embodiments within the scope and range of equivalents of the claims and without departing from the invention. Also, the embodiment selected for illustration in the figures is not shown to scale and is not limited to the proportions shown.

FIGS. 1-4B depict an exemplary embodiment of a water heating system that is designated by the numeral "10." The water heating system 10 may also be referred to in the art as a boiler, a hydronic boiler, a water heater, a tankless water heater, or an instantaneous water heater, for example. The water heating system 10 generally includes a housing 12 defining a substantially enclosed interior region, a heat exchanger 13 contained within the housing 12, an inlet conduit for delivering water (or other suitable liquid) into the water heating system 10, an outlet conduit for distributing heated water (or other suitable liquid) from the water heating system 10, a fuel-fired burner, a combustion inlet 14 for introducing air into a fuel-fired burner, an exhaust gas outlet 16 for expelling products of combustion, and an automatic air vent 18.

Figure 4A:
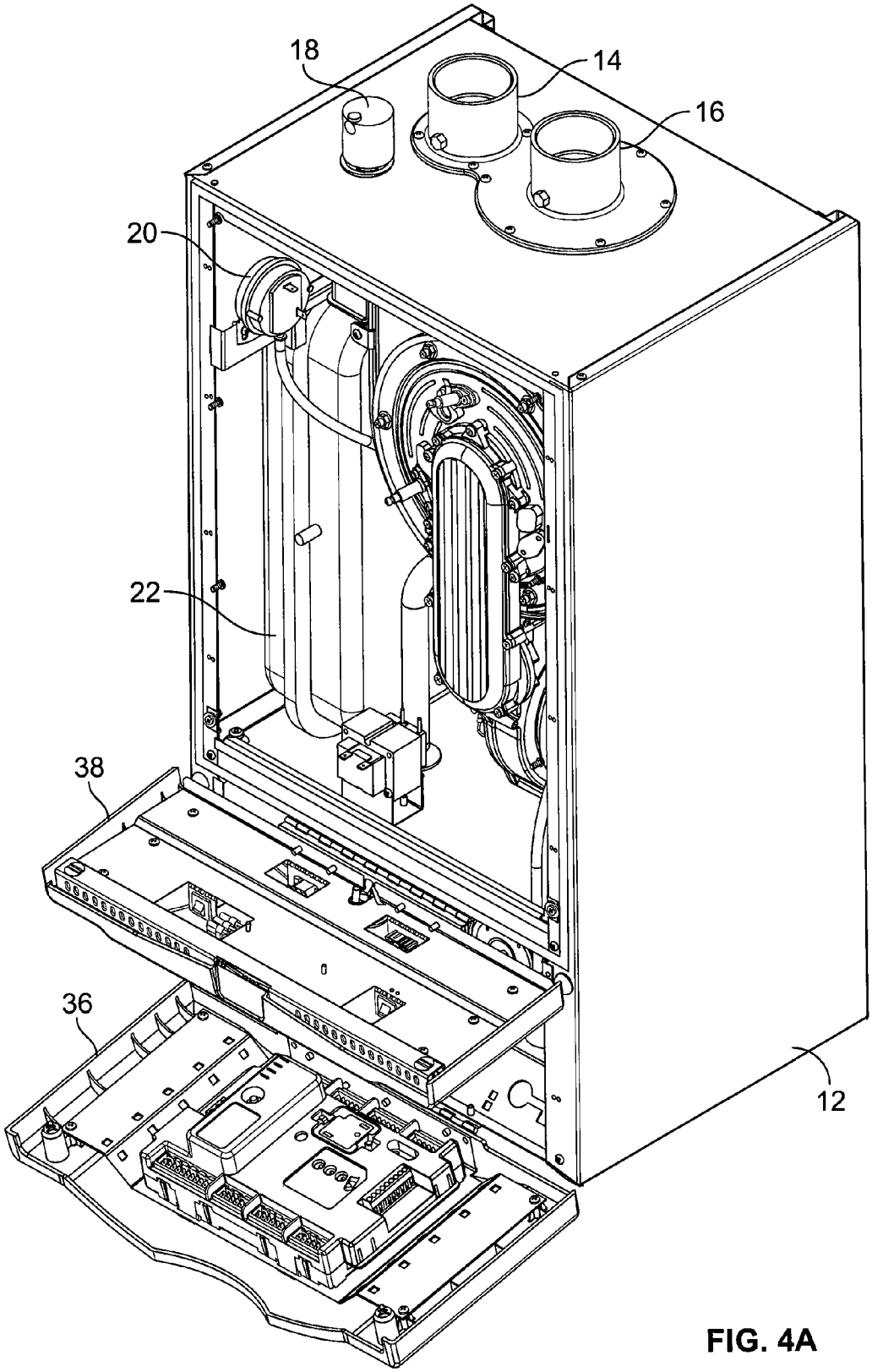
FIG. 4A is a perspective view of the water heating system of FIG. 1, wherein the lower access panel and the control panel are both shown pivoted to an open position and the top panels are omitted to reveal internal components of the water heating system.
Figure 4B:
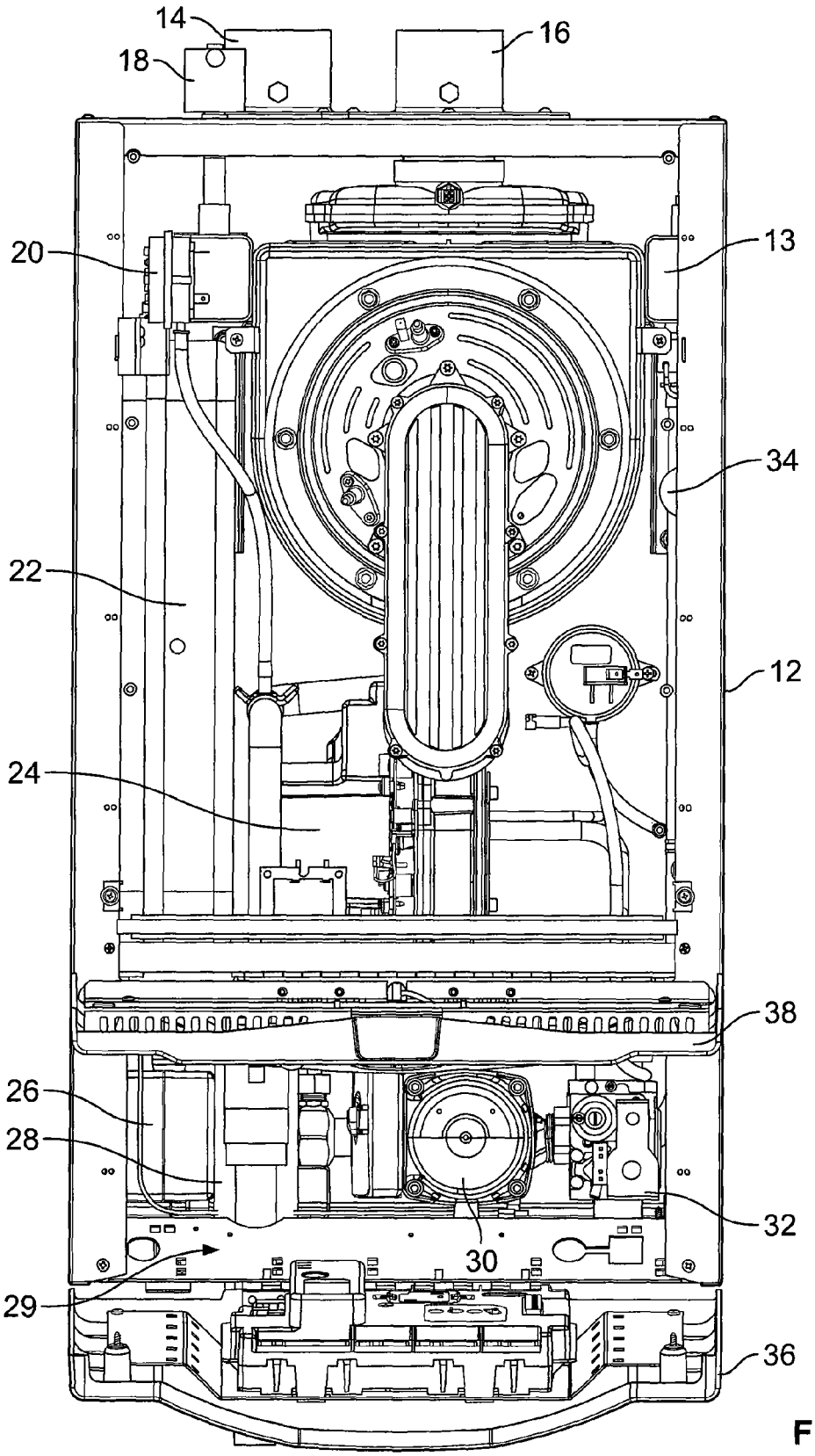
FIG. 4B is a front elevation view of the water heating system of FIG. 4A.

Referring now to FIG. 4B, the following components are positioned at least partially within the interior of the housing 12: the heat exchanger 13, a blocked vent pressure switch 20, an expansion tank 22, a combustion air fan 24, a three-way valve 26, a condensate trap 28, a pump 30, a gas valve 32, and a water pressure switch 34. Those skilled in the art will understand the function of those components of the water heating system 10.

Referring now to FIG. 1, a series of movable access panels are provided on the front face of the housing 12 to provide access to the internal components of the water heating system 10. More particularly, a lower access panel 36 is hingedly connected to a lower front edge of the housing 12. The access panel 36 is pivotable between a closed position (see FIG. 1) and an open position (see FIG. 2A).

In the open position of the access panel 36, a user can access at least the following components of the water heating system 10: the three-way valve 26, the condensate trap 28, the pump 30, the gas valve 32 and the terminal block/field wiring connections 29. The access panel 36 may be hingedly connected to the housing 12, as shown, or, alternatively, the access panel 36 may be removably coupled to the housing 12 or otherwise coupled in such a way as to open or close a passageway providing access to the interior region.

The access panel 36 includes the electronic components that are configured for operating the water heating system 10, such as ignition control, pump control, high limit temperate control and cascading/lead lag control of the water heating system 10. The ignition control feature is responsible for igniting the gas. The pump control feature is responsible for activating the water heating system pump. The high limit control prevents the temperature of the heated water from exceeding a pre-determined limit. The cascading/lead lag control feature facilities the connection of multiple water heating systems together.

A control panel 38 is pivotably connected to the front surface of the housing 12 is directly above the lower access panel 36. The control panel 38 is pivotable between a closed position (see FIG. 1) and an open position (see FIG. 3A). The panel 38 may be hingedly connected to the housing 12, as shown, or, alternatively, the panel 38 may be removably coupled to the housing 12 or otherwise coupled in such a way as to open or close a passageway providing access to the interior region.

The control panel 38 includes a power button 40 for on/off control of the water heating system 10, a temperature/pressure gauge 41 for displaying pressure and/or temperature levels of the water heating system 10, a visual display 42 which displays conditions and settings of the water heating system 10, DONE and NEXT buttons 44 and 46, respectively, for scrolling between menu items, and UP and DOWN arrow buttons 48 and 50, respectively, to change the numerical values of a particular menu item. The NEXT button 48 increments the display 42 to the next item in a menu structure, and the DONE button 50 returns the user to a Home screen.

The visual display 42 displays conditions of the water heating system 10, such as, for example, fluid pressure, stack temperature (i.e., the temperature of the exhaust gas), temperature rise across the heat exchanger, outlet water temperature, outdoor air temperature, and the firing rate based upon fan speed. The visual display 42 also displays the menu items of the water heating system 10, such as, for example, flame sense signal, alert code, lockout code, outlet temperature limit, domestic hot water limit setting, stack limit setting, minimum firing rate allowed, minimum forced firing rate, and maximum forced firing rate. The numerical value of a menu item may be adjusted using the UP and DOWN arrow buttons 48 and 50, respectively. The display 42 may be an LED or an LCD screen, for example.

Figure 2A:
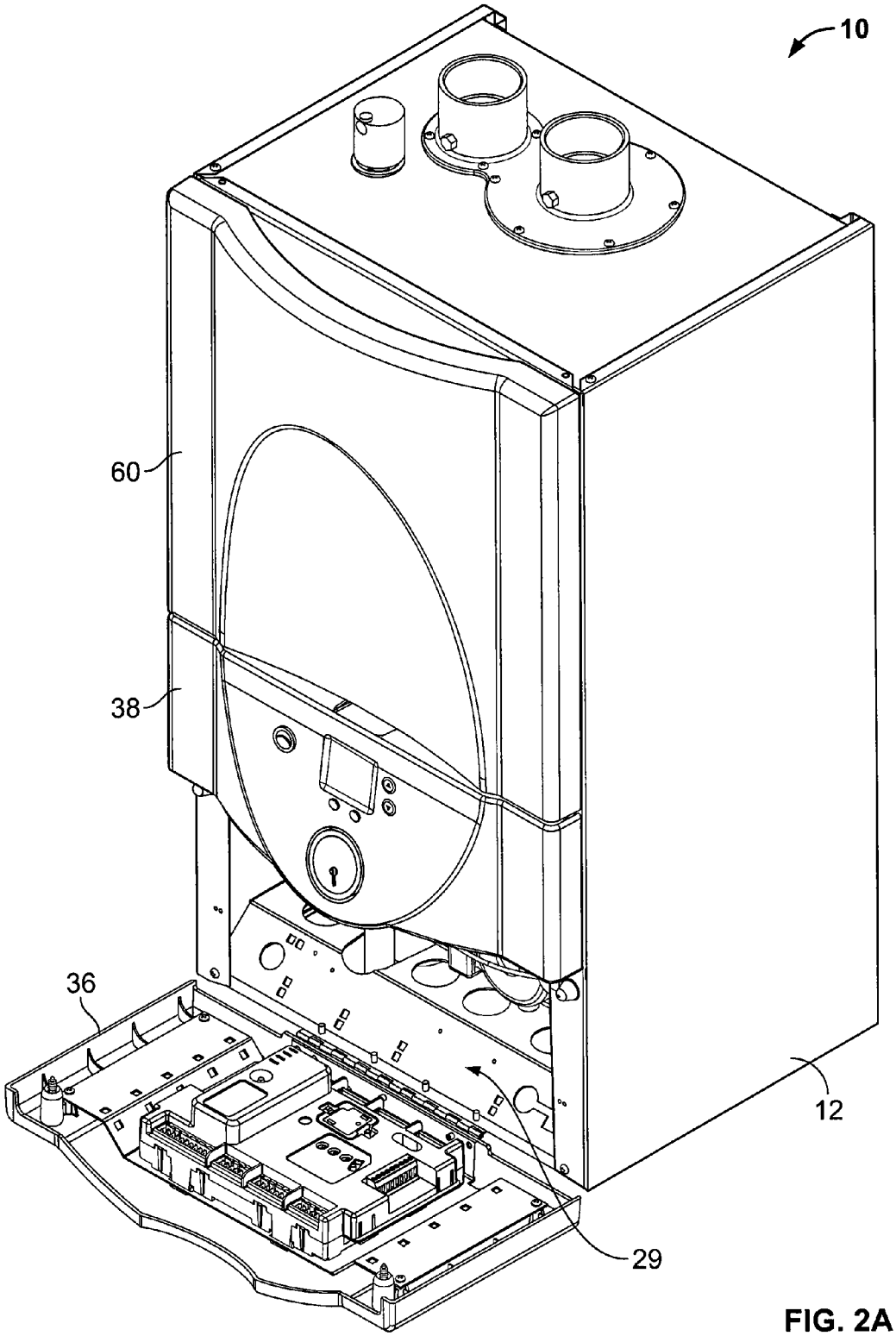
FIG. 2A is a perspective view of the water heating system of FIG. 1, wherein the lower access panel is shown pivoted to an open position to reveal internal components of the water heating system.
Figure 2B:
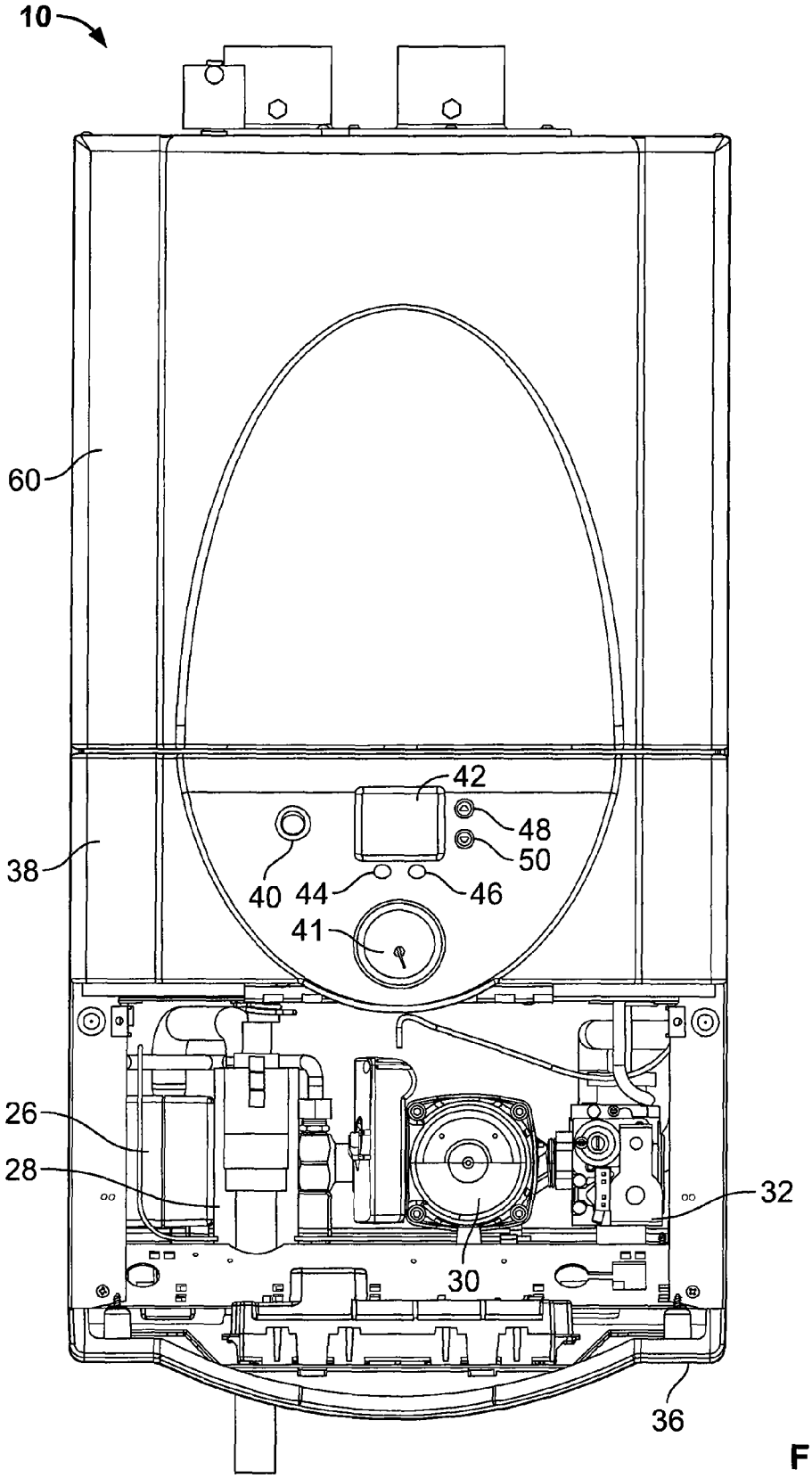
FIG. 2B is a front elevation view of the water heating system of FIG. 2A.

As best shown in FIG. 2B, while the lower access panel 36 is pivoted to an open is position, a user of the water heating system 10 can adjust the setting of the three-way valve 26, the condensate trap 28, the pump 30, the gas valve 32, and the field electrical connections (e.g., thermostat, system pump, alarm contacts), for example, while conveniently viewing the display 42 and the gauge 41 and/or adjusting the settings of the water heating system 10 via buttons 44, 46, 48 and 50. In this open position, components in the interior region can be accessed for disassembly, service, maintenance, repair, and/or setup. As is illustrated in FIG. 2B, full access to such internal components and to the control panel 38 is provided simultaneously. While the lower panel 36 is open, for example, the control components in the control panel 38 are fully visible. More specifically, in the illustrated embodiment, a user of the water heating system 10 can simultaneously access internal components of the system 10 from the front of the system 10 while seeing and/or manipulating control components also from the front of the system 10.

An access panel 60 is removably coupled to the front surface of the housing 12. The access panel 60 is shown mounted to the housing 12 in FIGS. 1-3B, and shown removed from the housing 12 in FIGS. 4*a* and 4B. The access panel 60 may be slid or pulled off of the front surface of the housing 12. Alternatively, the access panel 60 may be hingedly connected to the housing 12.

Figure 3A:
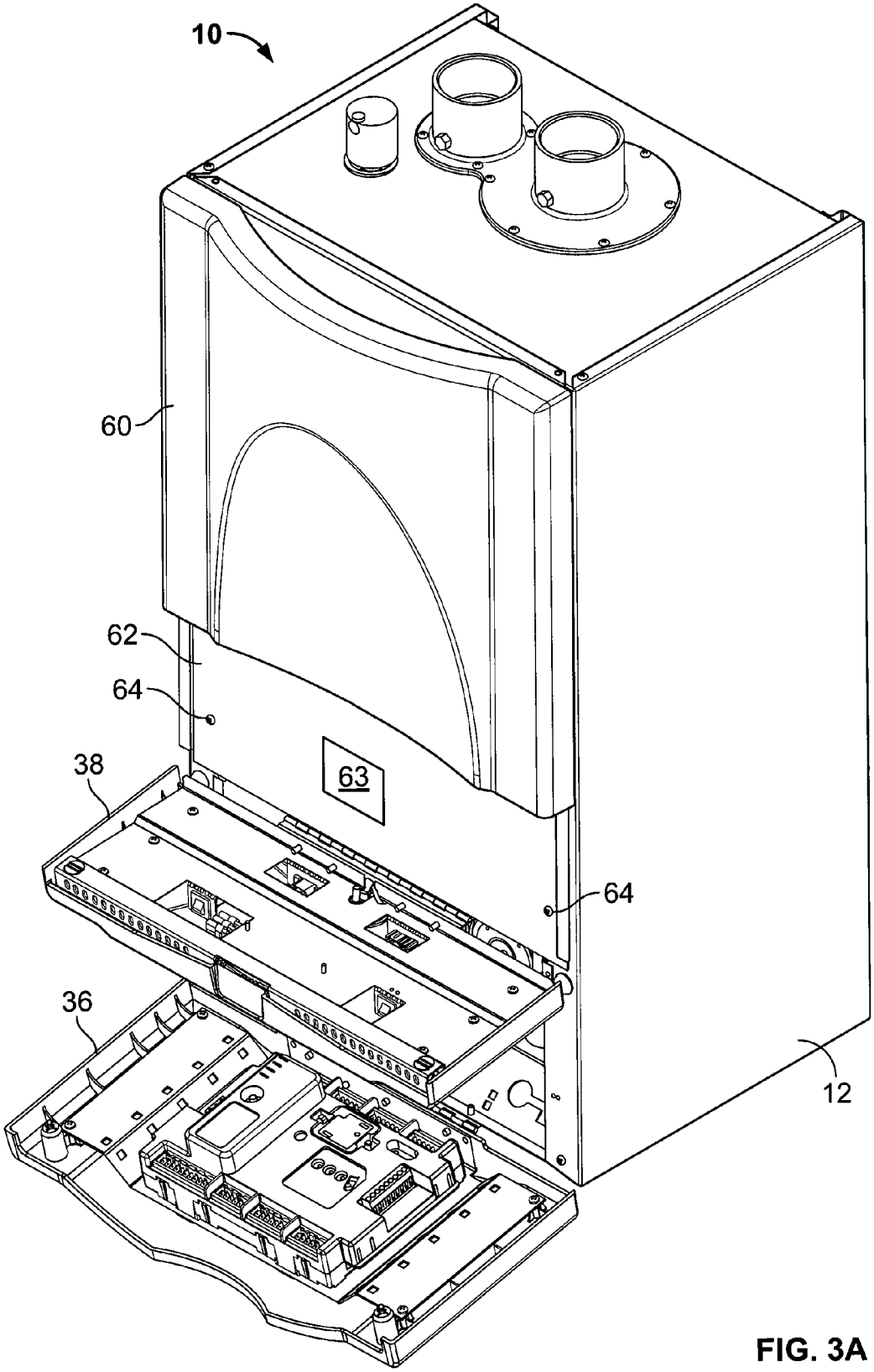
FIG. 3A is a perspective view of the water heating system of FIG. 1, wherein the lower access panel and the control panel are both shown pivoted to an open position to reveal internal components of the water heating system.
Figure 3B:
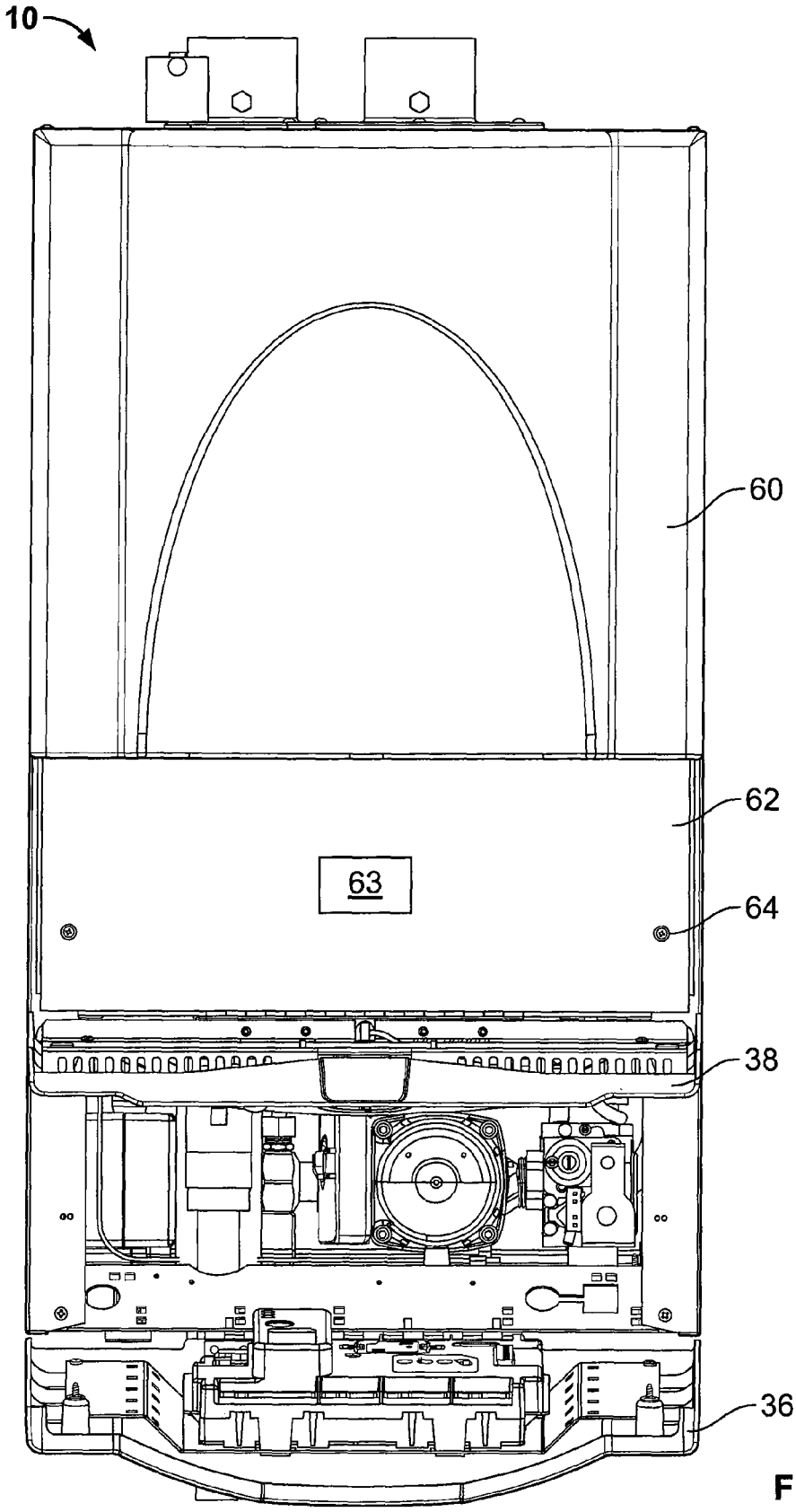
FIG. 3B is a front elevation view of the water heating system of FIG. 3A.

Another access panel 62 is removably mounted to the front surface of the housing 12. The access panel 62 is positioned beneath both the access panel 60 and the control panel 38. One or more labels 63, which include safety, operation and/or general information, are located on the front face of the access panel 62. The labels 63 are concealed by the control panel 38 while the control panel 38 is rotated to a closed position. The access panel 62 is mounted to the front surface of the housing 12 by a plurality of fasteners 64. To remove the access panel 60, the control panel 38 is pivoted downwards to the open position (as shown in FIG. 3A), the access panel 60 is detached from the housing 12, the fasteners 64 are removed, and the access panel 62 is removed from the housing 12. Alternatively, although not shown, the access panel 62 may be hingedly connected to the housing 12.

Once the access panel 62 is removed, the user may adjust, for example, the heat exchanger 13, the blocked vent pressure switch 20, the expansion tank 22, the combustion air fan 24, the three-way valve 26, the condensate trap 28, a pump 30, the gas valve 32, and a water pressure switch 34. If so desired, the user may pivot the control panel 38 back to the closed position (as shown in FIG. 2A), to conveniently view the display 42 and the gauge 41 and/or adjust the settings of the water heating system 10 via buttons 44, 46, 48 and 50 while manipulating the internal components of the water heating system 10.

In the interests of convenience, the control panel 38 and the panels 36, 60 and 62 are all positioned on the front side of the housing 12, and the control panel 38 is positioned directly adjacent the panels 36, 60 and 62. By positioning the control panel 38 (and, therefore, the display 42 and the gauge 41) in the vicinity of the panels 36, 60 and 62, a user does not have to look very far to observe the display 42 and the gauge 41, or operate buttons 44, 46, 48 and 50 while manipulating the interior components of the water heating system 10.

In use, and according to one aspect of the invention, an end-user or installer of the water heating system would perform several steps to access a component (e.g., a gas valve) within an interior region of the housing 12 of the water heating system 10, namely, maintain the control panel 38 in a position adjacent the housing 12 of the water heating system 10; move an access panel 36, 60 and/or 62 of the water heating system 10 from a closed position to an open position, thereby opening a passageway between the component and an exterior region of the water heating system 10; and access the component thru the passageway while manipulating a control (e.g., buttons 44, 46, 48 and/or 50) on the control panel 38.

Ornamentation of the sleek appliance-grade cabinet panels applied to the housing 12 is disclosed and claimed separately in co-pending U.S. Design patent application Ser. No. 29/376,266, which is incorporated herein by reference in its entirety. It will be appreciated that a wide variety and range of ornamental appearances can be selected for the cabinet panels while providing the functional and performance benefits disclosed herein.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A method for accessing a component within an interior region of a water heating system comprising:

maintaining a control panel in a closed position adjacent a housing of the water heating system;

moving an access panel of the water heating system from a closed position to an open position, thereby opening a passageway between the component within the interior region and an exterior region of the water heating system; and accessing the component through the passageway while viewing the control panel, moving the control panel to an open position to expose at least a portion of another access panel;

moving or removing the another access panel while the control panel is maintained in the open position, thereby opening another passageway between another component of the water heating system and the exterior region; and moving the control panel back to the closed position; and accessing the second component through the another passageway while viewing the control panel.

2. The method of claim 1, wherein the another access panel is positioned directly beneath the control panel.

3. The method of claim 1, wherein the step of moving the control panel comprises pivoting the control panel with respect to the housing without removing the control panel from the housing, and the step of moving or removing the another access panel comprises removing fasteners from the another access panel.

* * * * *